United States Patent [19]

Levielle

[11] 4,084,412

[45] Apr. 18, 1978

[54] APPARATUS FOR DYEING TEXTILE LENGTHS

[75] Inventor: Jean Levielle, Troyes, Aube, France

[73] Assignee: Teinturerie de Champagne, Troyes, Aube, France

[21] Appl. No.: 704,052

[22] Filed: Jul. 9, 1976

[51] Int. Cl.[2] ..... D06B 21/02

[52] U.S. Cl. ..... 68/5 C; 68/20; 68/22 B; 68/62; 68/177; 68/264

[58] Field of Search ..... 68/5 C, 20, 22 B, 62, 68/177, 178, 264

[56] References Cited

U.S. PATENT DOCUMENTS

| | | | |
|---|---|---|---|
| 2,350,342 | 6/1944 | Fay | 68/264 X |
| 3,053,070 | 9/1962 | Bjorck | 68/264 X |
| 3,894,411 | 7/1975 | Stanway | 68/62 X |
| 3,949,575 | 4/1976 | Turner et al. | 68/5 C |

FOREIGN PATENT DOCUMENTS

| | | | |
|---|---|---|---|
| 933,444 | 9/1955 | Germany | 68/22 B |
| 1,018,382 | 10/1957 | Germany | 68/177 |
| 1,785,141 | 12/1972 | Germany | 68/177 |
| 1,187,522 | 4/1970 | United Kingdom | 68/177 |

*Primary Examiner*—Philip R. Coe

[57] ABSTRACT

Apparatus for dyeing a length of fabric includes a chamber having a pair of cylinders, between which the fabric is held as it is dyed by dye emitted from an apertured pipe positioned between the cylinders. Adjacent to these cylinders are washers and a steam box. The length of fabric is formed into a loop on the cylinders and on a drive roll, and it is passed through the dyeing station where it is dyed. Heating elements and washing means are also provided in the chamber.

13 Claims, 2 Drawing Figures

APPARATUS FOR DYEING TEXTILE LENGTHS

The present invention relates to an apparatus for dyeing textile lengths of very diverse type or nature.

The object of this invention is to provide apparatus which can operate a process patented under the German patent documents No. DOS 2 145 827 — DOS 2 243 865, and which is defined as follows: chemical and optical dyeing of every textile material in a weak liquor ratio with 5 liters per kilo of material in the presence of special products at atmospheric temperatures or under pressure, such as:

saturated steam, more or less 180° C
superheated steam, more or less 180° C
hot air, more or less 230° C There are already known processes and apparatuses for the dyeing of textile articles, but which have, generally, the disadvantage of being able to treat only quite specific textiles, woven or knitted in a certain way, and particular materials, such as wool, or of cotton, or of synthetic fibres.

In accordance with standard dyeing processes, the liquor ratio is relatively high, that is to say that, for the dyeing, it is necessary to have about 40 liters of liquid per kilogram of material to be dyed, without taking into account the washings and subsequent treatments which call for about 250 to 300 liters per kilogram of material. The traditional processes are also more complex and are more expensive to the extent where, very often it is necessary to use electrolytic media which cause dangers of soiling at the times of transfers and of draining the apparatuses of dye solutions used. These processes are also more expensive in so far as the steam energy necessary for the heating the water is greater, given the larger volume of water used in the standard processes. Finally, these processes do not enable dyeing at high speed.

The object of the present invention is to provide apparatus which provides a simple working process enabling considerable economies to be effected and which presents very little danger of soiling.

Another object of the invention is to provide an apparatus for putting this process into practice, which is easy to set up, easy to handle, and which enables the treatment of various types of textile lengths, knitted or woven, and of different materials.

To this end, the invention relates to a apparatus which can perform a process for the dyeing, bleaching, washing or all other treatments of textile lengths, characterised in that:

the textile length is positioned in the apparatus by causing to pass through the various working stations, and the textile length is caused to unwind at a metric unwinding speed of the order of 20 to 800 meters per minute;

the textile length is impregnated with dyestuff by padding or spraying, with or without pressure, by spraying or combination with compressed air, or by immersion;

the dyeing is then fixed in a steam atmosphere, at atmospheric pressure, either at high temperature in a saturated steam atmosphere, superheated steam or with hot air and at a variable temperature, as a function of the textile piece being treated;

the textile piece is dried by padding, or by extraction of the water by compressed air, or by spraying;

all of these operations of impregnation, fixing, washing or drying of the textile piece are carried out with a weak liquor ratio.

The different operations for putting the process into practice enable a considerable economy in water, in dyeing and washing solutions in so far as they are carried out in a liquor ratio (1 to 5 liters of liquid per kilogram of material) much lower than the standard liquor ratios.

This process also enables the avoidance of the use of electrolytic media for the dyeing of cellulosic fibres, which avoids dangers of soiling at times of transfer or emptying of the dyestuff and washing liquors.

This process also makes possible an economy in steam energy in so far as the volume of water heated is less. Finally, this process makes possible a high dyeing speed which substantially increases the production of textile lengths to be treated.

In accordance with another characteristic of the invention, a plurality of lengths of textile material to be dyed simultaneously are disposed side-by-side in the dyeing apparatus.

This enables the production of dyed lengths to be further increased and consequently the widening of the machine.

The invention also relates to an apparatus for dyeing textile lengths, characterised in that it comprises a vessel provided with an opening for entry and exit of the textile material, this vessel including, moreover, a hood in its upper part and a cuvette in its lower part, holding the dyestuff and washing liquor, a station for padding or impregnation and dyeing, a cylinder for carrying the textile length along, washing elements, a steam box, elements for heating the hood, a protective device for the textile length, rolling members and guiding members, in order that the textile length follows a predetermined unwinding path, and checking members such as thermometers to ascertain the temperature of the dyestuff and washing liquor, as well as the temperature in the interior of the vessel.

This apparatus enables dyeing, bleaching, washing after printing, carrying out subsequent treatments on textile lengths presented in tubular form or in width; these lengths may be continuous or discontinuous, products of a circular knitting machine, a warp knitting machine or flat knitting machines of all types. This apparatus also enables dyeing of warps and wefts — in materials such as cotton, of fibres of artificial or animal origin, or polynosic, acrylic, and polyester materials, and polyamides as well as all synthetic fibres which are single or mixed.

The present invention will be better understood by means of two embodiments of apparatus for dyeing textile pieces, enabling the putting in practice of the dyeing process according to the invention, shown diagrammatically on the accompanying drawings, in which.

Figure 1:
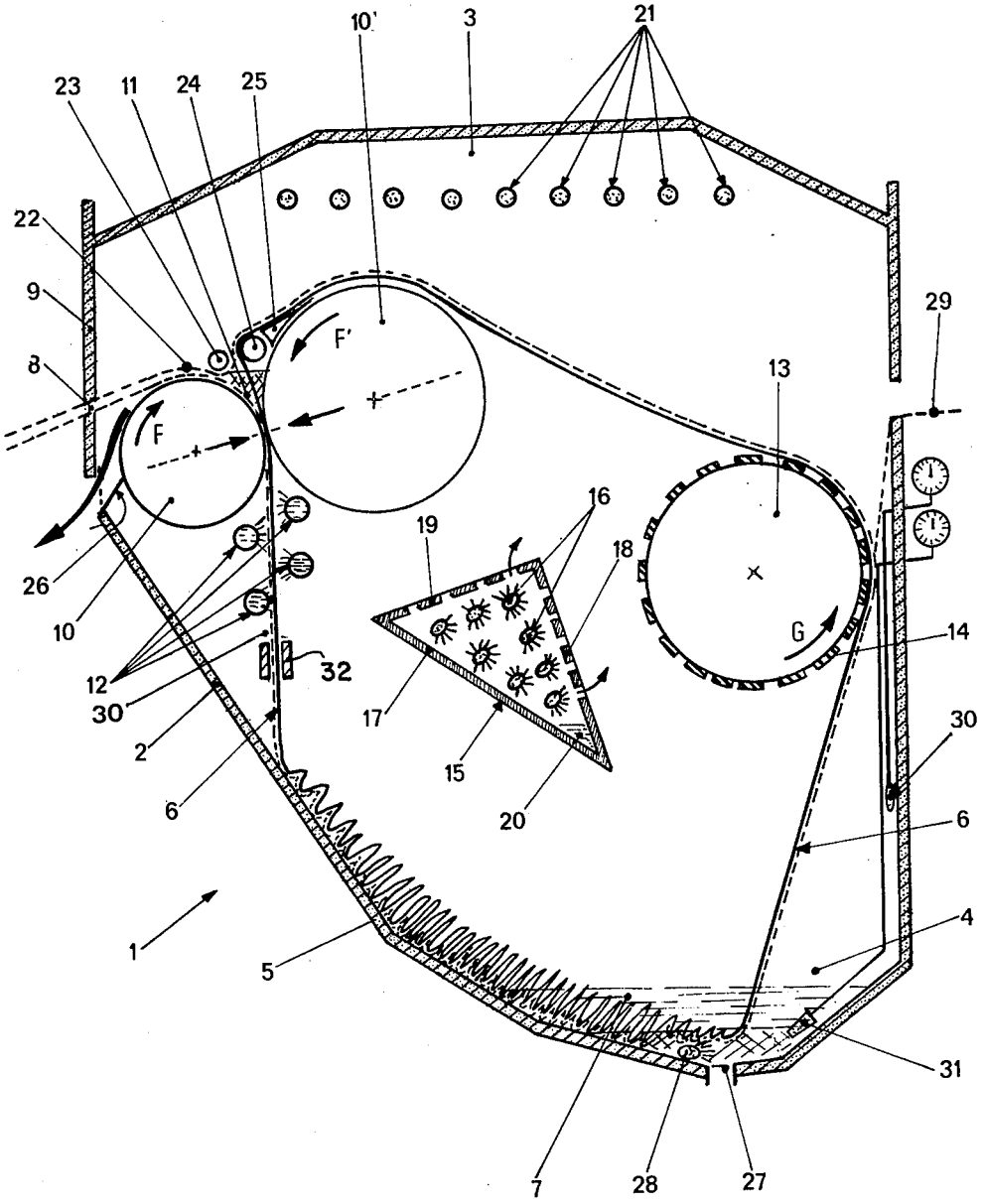
FIG. 1 is a side sectional view of the dyeing apparatus.

In accordance with FIG. 1, the dyeing apparatus 1 is constituted by a vessel 2 having, in its upper part, a hood 3 and, in its lower part, a cuvette or chamber 4 which comprises the lower part of the vessel 2. The wall 5 of the vessel 2 is shaped in such a way that the textile piece 6, once located in position in the apparatus, rests permanently on the interior surface of the wall 5 and comes into contact with the bottom of the cuvette 4 holding the dye and washing liquor 7.

The vessel 2 is provided with an inlet and outlet opening 8 arranged in the wall 9. This opening permits the passage of the textile piece 6 at the time when it is set up in the apparatus 1.

This apparatus moreover includes a padding station constituted by two cylinders 10 and 10' pressed against one another. It is to be noted that the axis of the cylinder 10 is disposed slightly lower than the axis of the cylinder 10', this being to allow the evacuation of waste waters, a procedure which will be described hereinafter.

The dyeing apparatus 1 includes a dyestuff-impregnation station constituted by a distributor 23. The cylinders 10 and 10' rotate in the directions of the arrows F and F' squeezing the textile piece 6 and carrying same along towards the washing elements constituted by washing sprayers 12 which impregante the textile piece 6 with water. In the region of the sprayers 12, a distributor 32 of compressed air and provided with an air injector will allow the wetted piece to swell and form a balloon and thus avoid the occurrence of creases or breaks. A driving cylinder 13 is provided in the apparatus 1 to take charge of the textile piece 6 and carry it along towards the padding station 10, 10'. This driving cylinder turns about its axis in the direction of the arrow G. Rubber strips 14 are fixed on the external periphery of the cylinder 13 in order better to enable the latter to take charge of the textile piece 6 and lead it towards the padding station.

A steam box 15 is located between the padding station 10, 10' and the driving cylinder 13. This box includes steam distribution elements 16 necessary during the dyestuff-fixing operations. This box 15 is in the form of a prism arranged in the vessel 2 in such manner that its sides 17, 18 and 19 are inclined. This enables collection of waters at the start of the heating in the lower corner 20 of the box.

Heating elements 21 are located in the hood 3 of the apparatus to heat the interior of the vessel during the dye-fixing operations, in order to avoid condensation which would be harmful as regards the liquor ratio. A protective bar 22 is located above the cylinder 10 of the padding station in order immediately to stop the machine in the event of accidental introduction of a foreign body or of a hand. The bar 22 is either connected as a switch or is coupled to a switch (not shown) which is connected in circuit with the motor which drives roller 13. When an individual touches the bar 22, it energizes the switch to disconnect the motor. Such apparatus is well known in the art. A guiding roller 24 for the textile piece 6 is provided above the dyeing station 23 and determines a course of unwinding of the textile piece 6 which is thus flooded on all its sides by the dyetuff solution. A detaching flap 25 is arranged above the cylinder 10' of the padding station to lead the textile piece 6 from the cylinder 10' over the guiding roller 24.

A movable flap 26 is arranged in the wall 5 of the vessel 2. This movable flap is capable of pivoting towards the wall 9 of the vessel 2 into a closing position or towards the periphery of the cylinder 10 into an opening position, in order to permit the evacuation from the dyeing station of dirty waters which are collected in the V-shaped space defined by the upper part of the padding station 10, 10', that is to say by the periphery of the cylinder 10, 10'. The flap 26 is shown in the washing and waste waters extraction position in FIG. 1. When the washing operations have been completed, there is an overflow and this overflow escapes over the smaller roller 10 because of the tilt of the axis between the two rollers 10 and 10'. The cloth inside the vessel would be damaged if the waste waters were distributed inside the vessel. On the other hand, during impregnation, that is, when the dye is impregnated into the cloth at the padding station, the pivoting flap 26 is placed in the closed position to prevent dye from entering the waste waters channel. The dye, therefore, returns to the bottom of the chamber and does not risk deteriorating the cloth within the chamber. A drainage valve 27 is provided in the bottom of the cuvette 4 to evacuate the dye and washing liquor contained in the vessel 2.

This dye and washing liquor is rapidly heated by a heating device 28 constituted by a pipe directly dispensing steam.

Checking members constituted by thermometers 30, 31 enable the temperature to be ascertained, both in the interior of the vessel 2 and in the dye and washing liquor. These operations are necessary, as a function of the nature of the textile piece 6 being treated. Finally, the vessel 2 is provided with a fixation point 29 necessary at the time of placement of the textile piece 6 in the apparatus 1.

In order to carry out dyeing operations, the following is the manner of procedure.

First of all the textile piece 6, shown dotted in FIG. 1, is put into place by passing one end of the textile piece 6 through the inlet opening 8 into the vessel 2, then into the dyeing station 23 and the space 11, and between the cylinders 10 and 10' of the padding station. The cylinders then carry the textile piece 6 along towards the washing sprayers 12, then towards the bottom of the cuvette 4 where the textile piece 6 contacts the bottom during the dyeing. The textile piece 6 will be immersed during washing.

The end of the textile piece 6 is then caused to go up again towards the fixation point 29. This end of the textile piece 6 remains fixed at the point 29, until the whole piece is introduced into the vessel 2, with the exception of the second free end of the piece 6. Then, with the help of the driving cylinder 13, the end of the textile piece 6, detached from its fixation point 29, is led towards the cylinder 10' of the padding station, then it passes over the detaching flap 25 and the guiding roller 24; the textile piece 6 is then carried to pass below the distributor 23 and the protective bar 22, then into the outlet opening 8 where the two free ends of the textile piece 6 are joined so that the piece 6 forms a loop, such as is shown in full lines in FIG. 1.

Once the loop formed by the textile piece is in position, the treatment operations are carried out to bring about the dyeing proper.

First of all the textile piece 6 is caused to pass into the dyeing station 23, then into the padding station 10, 10', then into the cuvette 4. The piece 6 is led on to the driving cylinder 13, which carries same along towards the cylinder 10' of the padding station. The piece 6 is caused to pass over the detaching flap 25 and over the guiding roller 24 in order to cause it to return towards the dyeing station 23 and into the space 11.

The textile piece 6 is then impregnated with dye on a level with the distributor 23. This dyestuff distributor is constituted by a pipe pierced over its full length and which sprays the textile piece 6. At the time of this operation, the movable flap 26 is in the closed position.

After having passed through the dyeing station 11, the textile piece 6 is caused to pass through the padding station 10, 10' perpendicularly to the plane containing the axes of the cylinders 10, 10' in order to get uniform distribution of dye over the two surfaces. When the dye is distributed entirely over the textile length 6, the padding station is loosened and textile length 6 carries out a rotational movement driven by the cylinder 13 and the cylinder 10'.

The dye is then distributed in a homogeneous manner by causing the textile length 6 to revolve for a time running from 20 to 30 minutes, the temperature in the vessel 2 being of the order of 50° to 60° C. These conditions are particularly suitable for a good penetration of the dye in solution into the textile length 6.

The dye is then fixed by first of all heating the hood 3, in order to avoid the condensation detrimental with regard to the liquor ratio. The steam is sent directly by the distribution elements 16 in the steam box 15. A thermometer 30 arranged in the vessel 2 away from the dye and washing liquor enables checking of temperature in the interior of the vessel during the dye-fixing procedure which lasts for about 60 minutes.

Rinsing is then carried out, first of all by freely rotating the textile length 6 without tightening the padding station, in order to avoid breaks, the textile length 6 being very hot at the start of the rinsing operations. If necessary, the position of the undulations may also be varied by the injection of air from a distributor 32.

The textile length 6 is caused to pass in front of the washing sprayers 12 which wash the material at high pressure. The drainage valve 27 is opened. When the textile length 6 is sufficiently cold, the pressure of the padding station is restored and the ejection flap 26 is opened and comes to rest on the periphery of the cylinder 10 and thus enables the evacuation of dirty waters captive in the V-shaped space in the upper part of the padding station.

Finally, the textile length 6 is washed, with boiling if necessary. For that purpose the pressure of the padding station is relaxed and the textile length 6 goes round in a weak liquor ratio. The water contained in the cuvette 4 is rapidly heated by the heating device 28, a thermometer 31 checking the temperature of the bath. It is obvious that several rinsings could be carried out following this operation.

It should be noted that the cylinders 10 and 10' of the padding station must be extremely soft in order to envelop the textile length 6 well and thus assist the fluid-tightness while preventing breaks always possible. The cylinders 10, 10' and 13 must be of a sufficiently large diameter to obtain a large spread of materials to be treated and also to obtain maximum adherence, which will prevent slippage of the textile length 6 and hence glossing of same. The motors for driving the rollers also turn so much the less quickly because the diameter is large.

In order to carry out the washing operations, it is also necessary that the flap 26 be semi-stiff in order to avoid stripping off from the cylinder 10. The cylinder 13 and the cylinder 10' must spread the same amount of material and must turn in a synchronous manner.

In order to carry out the dyeing operation with maximum efficiency, the apparatus must work at about 300 meters per minute. This apparatus, moreover, enables the treatment of a plurality of textile lengths at the same time, partitions being provided for this purpose.

Figure 2:
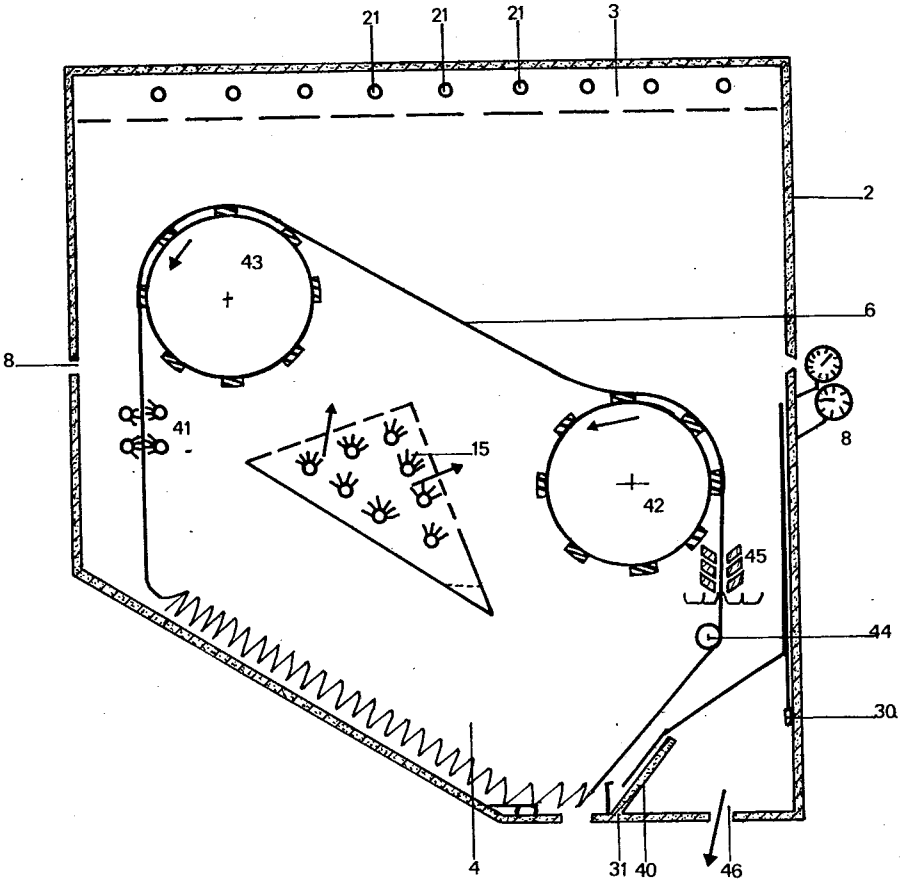
FIG. 2 is a side sectional view of a second embodiment of the dyeing apparatus.

According to FIG. 2, it is possible in a simple manner to use compressed air to dry the textile length, and to use sprayers or a spraying nozzle to distribute the dye.

It has also been found that there is no longer any fulling by pressure of two cylinders. The spraying of the dyestuff is effected at the station 41.

This cuvette 4 holds the surplus of dyestuff during the dyeing or otherwise the washing liquor, if necessary.

A weir 40 prevents loss of dyestuffs, whence there is a certain enconomy. The weir also prevents the utilization of an unnecessary bath which would increase the bath ratio, that is, the number of kilos of material per kilo of bath. It also serves as a guide to prevent any accumulation of cloth in the right angle located on the right of the chamber, which could result in irregular pulls harmful to the desired properties of the cloth.

A bar or a free roller 44 guides the length 6 vertically through compressed-air injector elements 45, which constrains the rinsing water to leave the textile material (extraction, drying).

This thrown-off water drops into 46 and is evacuated.

The cylinders 42 and 43 turn at the same speed in the direction of the arrow G.

The general components of this machine are the same in the forgoing description.

The making of a material under pressure will necessitate special preparations, such as: increasing the thickness of the metal sheets, blocking of the openings through which the material is introduced, non-return valve, pressure relief valve (safety), which will not in any way change the principle of the invention.

Of course, the invention is not restricted to the embodiments described and shown, from which other form and other embodiments could be provided, without thereby departing from the scope of the invention.

I claim:

1. Apparatus for dyeing textile lengths comprising:

a vessel having an opening for the entry and exit of the textile material, said vessel including a hood in its upper part and a cuvette in its lower part, said cuvette holding a dyestuff and a washing liquor, heating means in said hood for heating the hood, temperature measuring apparatus to ascertain the temperature of the dyestuff and washing liquor, as well as the temperature in the interior of the vessel, a station in said vessel for padding or impregnating and dyeing said textile material, a cylinder for carrying the textile material along a path from said station, and means disposed along said path in said vessel including washing elements for washing said textile material, a steam box, a protective device to protect against the intrusion into the vessel of a hand or the like of the operator of the apparatus, guide rolling members for guiding said textile material, and an auxiliary guiding member adjacent to said guide rolling members for insuring that a length of textile material follows a predetermined path.

2. Dyeing apparatus in accordance with claim 1 including compressed air injection elements, and a drainage opening in the vessel.

3. Dyeing apparatus in accordance with claim 1 wherein said padding station comprises two cylinders, the axes of which are at different levels, one cylinder being located close to the wall of the vessel and below the other cylinder which is situated adjacent to the one cylinder and near the central part of the vessel.

4. Dyeing apparatus in accordance with claim 3 wherein said vessel is provided with a movable flap disposed adjacent to said opening therein and bearing against one of the cylinders of the padding station to enable the evacuation of waste water from the vessel.

5. Dyeing apparatus in accordance with claim 1 and including dyestuff dispensing means adjacent to said path.

6. Dyeing apparatus in accordance with claim 1 wherein said cylinder for carrying the textile length along includes rubber strips at its periphery, to facilitate the unwinding of the textile length.

7. Dyeing apparatus in accordance with claim 1 wherein the cuvette, formed by the lower part of the vessel, is provided with a discharge valve for evacuating the dyestuff and washing liquor.

8. Dyeing apparatus in accordance with claim 1 wherein the elements for washing a textile length are constituted by washing sprayers for impregnating a textile length with water.

9. Dyeing apparatus in accordance with claim 1 wherein the steam box includes steam-distribution elements.

10. Dyeing apparatus in accordance with claim 9 wherein the steam box is in the shape of a prism so disposed in the vessel that all of its sides are inclined to enable collection of waters at the start of heating in the lower corner of the box.

11. Dyeing apparatus in accordance with claim 1 wherein the device for protecting the textile length is constituted by a protective bar located above that cylinder of the padding station which is situated close to the wall of the vessel.

12. Dyeing apparatus in accordance with claim 1 wherein the guide rolling members for the textile length are constituted by a dyestuff distributor and by a guiding roller.

13. Dyeing apparatus in accordance with claim 1 wherein said auxiliary guiding member for guiding the textile length is a loosening flap located above that cylinder of the padding station which is situated in the central part of the vessel.

* * * * *